US008292708B2

(12) United States Patent
Viggers et al.

(10) Patent No.: US 8,292,708 B2
(45) Date of Patent: Oct. 23, 2012

(54) MAGNETIC REGISTER COVER

(75) Inventors: Cheryl F. Viggers, Setauket, NY (US); Robert W. Viggers, Setauket, NY (US); Karen A. Poidomani, Stony Brook, NY (US); Kevin Poidomani, Stony Brook, NY (US)

(73) Assignee: Elima-Draft Incorporated, Setauket, NY (US)

( * ) Notice: Subject to any disclaimer, the term of this patent is extended or adjusted under 35 U.S.C. 154(b) by 355 days.

(21) Appl. No.: 12/693,519

(22) Filed: Jan. 26, 2010

(65) Prior Publication Data

US 2010/0190432 A1 Jul. 29, 2010

Related U.S. Application Data

(60) Provisional application No. 61/206,050, filed on Jan. 26, 2009.

(51) Int. Cl.
*F24F 13/08* (2006.01)

(52) U.S. Cl. ..... 454/275

(58) Field of Classification Search ..... 454/275
See application file for complete search history.

(56) References Cited

U.S. PATENT DOCUMENTS 4,110,552 A 8/1978 Lombardi
4,233,586 A * 11/1980 Kaplow et al. ..... 335/303
4,502,368 A * 3/1985 Hempel ..... 454/277
4,520,715 A 6/1985 Coomes et al.
4,911,066 A * 3/1990 Carew ..... 454/358
5,125,197 A * 6/1992 Fuchs ..... 52/202
5,479,984 A * 1/1996 Easterbrook et al. ..... 165/96
D394,901 S * 6/1998 Governale et al. ..... D23/354
5,930,927 A * 8/1999 Griffin et al. ..... 40/621
6,257,976 B1 * 7/2001 Richardson, III ..... 454/309
6,292,957 B1 * 9/2001 Thompson ..... 4/609
6,749,499 B1 6/2004 Snyder
7,422,273 B2 * 9/2008 Varga ..... 296/210
7,651,390 B1 * 1/2010 Profeta et al. ..... 454/307
2002/0069599 A1 * 6/2002 Dhallan ..... 52/302.1
2003/0134587 A1 * 7/2003 Hunter ..... 454/289
2008/0160904 A1 * 7/2008 Yi et al. ..... 454/309
2008/0227382 A1 * 9/2008 Profeta et al. ..... 454/358
2009/0084050 A1 * 4/2009 Moore et al. ..... 52/203
2011/0047759 A1 * 3/2011 Reiter ..... 24/303

* cited by examiner

*Primary Examiner* — Steven B McAllister
*Assistant Examiner* — Frances H Kamps
(74) *Attorney, Agent, or Firm* — Renner, Otto, Boisselle & Sklar, LLP

(57) ABSTRACT

A register cover (also referred to as a vent cover) for use in a building that has heating, ventilation and air-conditioning (HVAC) systems that utilize air registers. The register cover completely covers the register and secures to the register using a magnet in order to substantially block the flow of forced air through the register that is covered by the register cover. In the case of a non-metallic register, a method is disclosed for retrofitting the non-metallic register by placing metallic mounts on the register in order to secure the register cover over the register with one or more magnets.

15 Claims, 5 Drawing Sheets

MAGNETIC REGISTER COVER

RELATED APPLICATION DATA

The present application claims the benefit of U.S. Provisional Application Ser. No. 61/206,050 filed on Jan. 26, 2009, the disclosure of which is herein incorporated by reference in its entirety.

TECHNICAL FIELD OF THE INVENTION

The present invention relates generally to the field of heating, ventilation and air-conditioning (HVAC) systems that utilize air registers (also referred to as vents or diffusers) that assist in the transfer of air from ducts into living and work areas within homes or buildings. In particular, the present invention relates to eliminating the transfer of air through inadequately and/or inefficiently designed air registers during times that the transfer of air through a register is undesirable.

DESCRIPTION OF THE RELATED ART

Air forced through heating, ventilation and air-conditioning (HVAC) systems is generally output through ducts to one or more registers (also referred to as a vents or diffusers), which are located in predetermined locations throughout a building. HVAC systems generally have a series of ducts contained within the building's walls, ceilings and attic crawl spaces. The ducts carry forced air (e.g., heated air or cooled air) to the registers located in the living and/or work areas. The ducts are attached to the back side of an interior surface (e.g. sheetrock, ceiling, wallboard, a finished or un-finished surface, etc.) at openings designed for the register. A register fits into the opening in the wallboard and is attached by several sheet metal screws.

It is well known to provide dampers in a register to control the flow of air out through a register. Today, it is common for the register to be provided with a plurality of closely spaced louvers that are controlled by an external lever to adjust the louvers in an open position, a closed position or a position somewhere in between open and closed. The closed position of this type of damper is intended to have the louvers closely overlap each other and thus impede the flow of air through the air register. In the closed position, such a register is intended to prevent the escape of air from the HVAC system through the register. Thus, air (e.g., warming air, cooling air) circulated by the HVAC system may be re-directed to warm and/or cool another portion of the house or building.

One problem with such conventional registers is that even when the louvers are in the closed position air can readily pass through the louvers. Therefore, instead of bypassing the register, as intended by the user, the air escapes the louvers and warms or cools the area in which the register is located, thereby wasting energy. Another problem with such conventional registers is that they are typically made from metal, which acts as a conductor and has very low insulative properties.

SUMMARY

A need exists for a register cover to easily secure to a register with an interface that covers the entire register and any sidewalls of the register in order to prevent heating and/or cooling air forced from a HVAC system from escaping through the register.

The register cover may be used within residential homes that have HVAC air registers, vents or diffusers. The register cover is intended to eliminate heat loss and cold drafts from leaving and/or entering building spaces (e.g., residential living areas) through the registers in which the register cover is secured. The transfer of air takes place through inadequate and/or inefficiently designed HVAC air registers/vents that are commonly installed in residential homes, as discussed above.

In one embodiment, the register cover attaches in seconds to the register through the use of magnets. The register cover is made from a plastic material, which may be molded from a plastic composite material, such as, PVC or ABS, for example. The register cover may take the form of a quadrilateral (e.g., square, rectangular, etc.) shape that has a top, bottom and four (4) sides (or side wall) that when put in place, covers the entire register. Alternatively, the register cover may take any desired shaped. When placed over the register, the sides of the register cover come in contact with the surface (e.g., wallboard, ceiling, or other finished or un-finished surface) that surrounds the register. The register cover forms a tight seal over the register, which eliminates the transfer of air from leaving and/or entering register. The register cover is attached to the register through one or more securing elements (e.g., magnets) that form a magnetic draw between the register cover and the register. In one embodiment, there are four (4) securing elements spaced apart in predetermined locations for securing the register cover to the register.

One aspect of the invention relates to a register cover including: a base member impervious to air, wherein the base member includes a front surface and a back surface; a side wall extending from the base member along a perimeter of the base member, wherein the side wall and the back surface form a cavity for receiving an associated register, herein the cavity completely covers the associated register including register sidewalls; and a plurality of a securing elements configured along the back surface to secure the base member to the associated register.

Another aspect of the invention relates to a method for attaching a magnetic register cover to a non-metallic register, the method including: providing a register cover, wherein the register cover includes a base member impervious to air, wherein the base member includes a front surface and a back surface; a side wall extending from the base member along a perimeter of the base member, wherein the side wall and the back surface form a cavity for receiving an associated non-metallic register and the cavity completely covers the associated non-metallic register; and a plurality of a magnets configured along the back surface to secure the base member to the associated non-metallic register; attaching one or more metallic mounts to the associated non-metallic register, wherein the one or more metallic mounts are configured to magnetically engage the magnets of the register cover; and placing the register cover over the associated non-metallic register, wherein the magnets of the register cover secure the register cover to the one or more metallic mounts and the register cover to create an interface between the sidewall and back surface of the register cover and the associated non-metallic register such that forced air is prevented from escaping through the interface.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

It should be emphasized that the term "comprises/comprising" when used in this specification is taken to specify the presence of stated features, integers, steps or components but does not preclude the presence or addition of one or more other features, integers, steps, components or groups thereof.

DETAILED DESCRIPTION OF EMBODIMENTS

Figure 1:
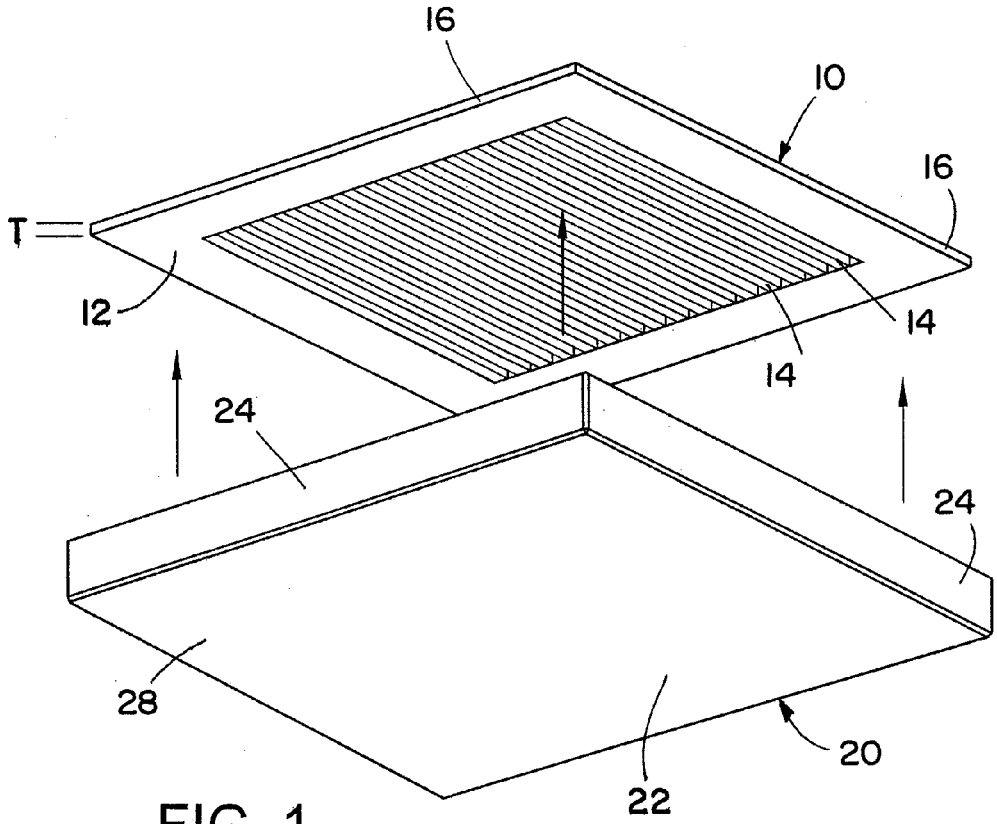
FIGS. 1 and 2 are exemplary perspective views of a register cover in accordance with aspects of the present invention and a conventional register in which the register cover may be secured over.

The present invention will now be described with reference to the drawings, wherein like reference numerals are used to refer to like elements throughout.

Referring to FIG. 1, a conventional register 10 for a heating, ventilation & air conditioning (HVAC) system is disclosed. The conventional register 10 illustrated in FIG. 1 is a ceiling register. In addition to ceiling registers, one of ordinary skill in the art will readily appreciate that the present invention may be used in connection with all types of registers (e.g., wall registers, louvered registers, patterned registers, etc.).

As shown in FIG. 1, the conventional register 10 includes face 12 having a plurality of openings 14 formed in the face 12 to allow forced air to escape through. The register 10 may further include louvers (not shown) that may be adjusted to control forced air flow through the register. The register 10 may also include sidewalls 16 that extend above a surface (e.g., wallboard, a wall, a ceiling, a finished surface, unfinished surface, etc.) in which the register is attached. The side walls 16 generally will extend above the finished surfaced generally by a thickness (T) of the face.

Figure 2:
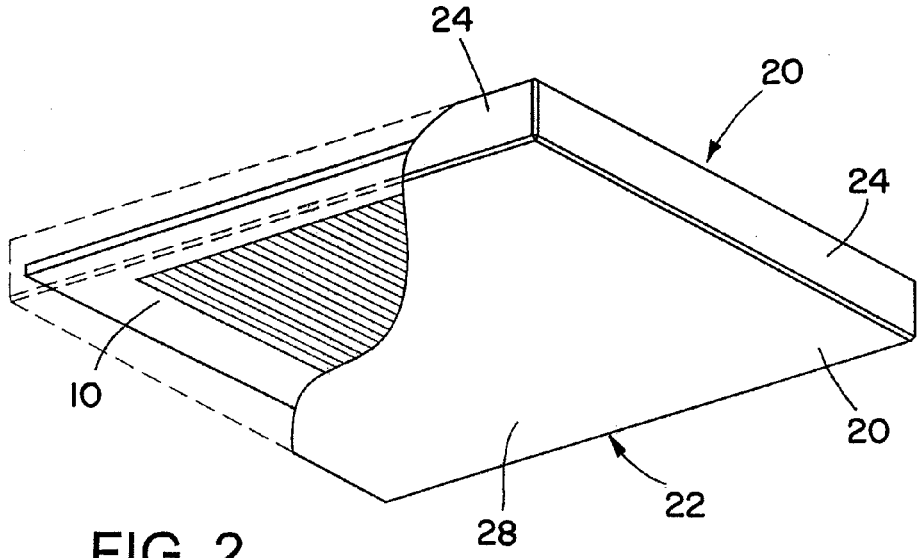

As indicated by the arrows in FIG. 1, the register cover 20 in accordance with aspects of the present invention is configured to be placed over the register 10, including the sidewalls 16. FIG. 2 illustrates the register cover secured to the register in accordance with aspects of the present invention in order to substantially prevent forced air from exiting through the register 10 or air from entering the register 10.

Referring to FIGS. 1 and 2, the exemplary register cover 20 in accordance with aspects of the present invention is disclosed. The register cover 20 is configured to be placed over a register to substantially block the flow of air from entering or leaving the register (e.g., register 10). The register cover 20 includes a base member 22, a side wall 24, and a plurality of securing elements 26 (shown in FIG. 3).

The base member 22 may be any desirable size or shape. Generally, the base member will be of sufficient size to enclose the register to which it is to be secured to. In one embodiment, base member 22 is sized to cover the entire register 10, including any sidewalls. The base member 22 is impervious to air, so that air forced through HVAC system will not escape through the base member covering the register 10. The base member 22 may be any desirable thickness. For example, the base member may have a thickness of about ⅛ inch to about ½ inch. One of ordinary skill in the art will appreciate that the dimensions disclosed herein are exemplary in nature and should not limit the scope of the appended claims.

Figure 3:
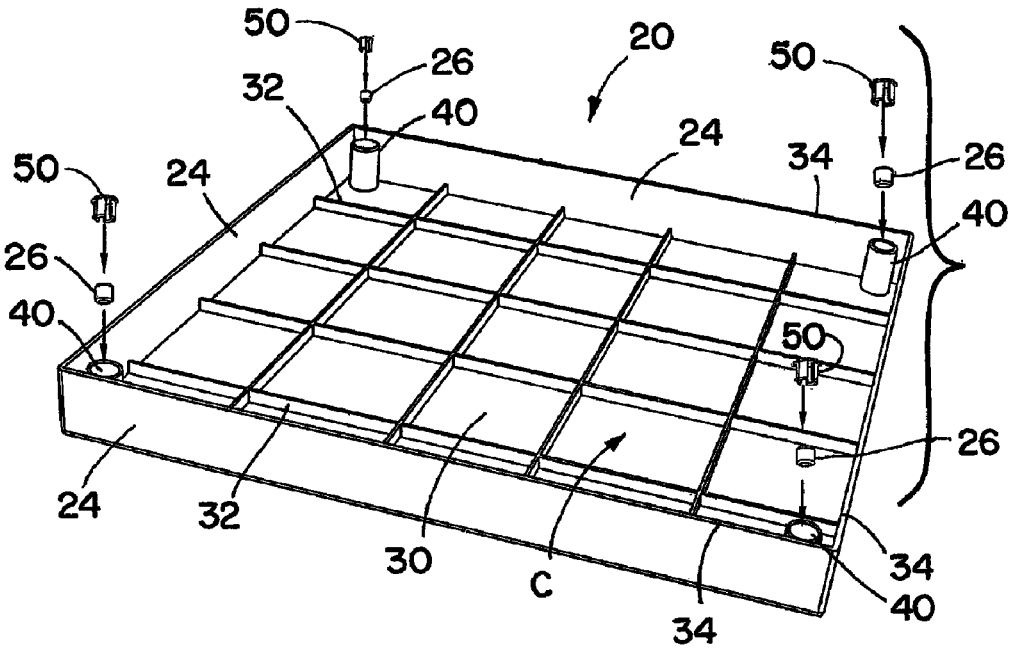
FIG. 3 is an exemplary perspective view of a rear surface of the register cover in accordance with aspects of the present invention.

As shown in FIGS. 1 and 2, the base member 22 includes a front surface 28 and an opposing back surface 30 (shown in FIG. 3). The front surface 28 may be planar or non-planar. In addition, the front surface 28 also may include a decorative pattern or other decorative feature (e.g., color, pattern, texture, etc.) to make the register cover 20 aesthetically pleasing.

As shown in FIG. 3, the back surface 30 may include one or more stiffener ribs 32. The stiffener ribs 32 may be any desired form. As shown in FIG. 3, the stiffener ribs 32 form a square or rectangular grid extending from the back surface 30. The stiffener ribs 32 may enhance the structural integrity of the register cover and/or provide additional support to the register cover, which may prevent warping or flexing of the front face 28 portion of the base member 22. The illustrated stiffening ribs have a thickness of about 0.044 inches and are spaced apart about 2.206 inches, for example. One of ordinary skill in the art will readily appreciate that the stiffener ribs are optional features.

The base member 22 may be made from any desirable material. For example, the base member 22 may be manufactured from an acrylonitrile-butadiene-styrene (ABS) material, a polyvinyl chloride (PVC) material, or any other suitable material. It may be desirable to select a material that includes superior insulative properties. Generally, it is undesirable to use a metal alloy to form the base member unless additional steps are taken to sufficiently insulate the material.

The base member 22 includes one or more side walls 24 that extend from the base member along a perimeter of the base member. The one or more side walls 24 and the back surface 30 form a cavity (C) for receiving an associated register (e.g. register 10). The cavity (C) completely covers the associated register including any register sidewalls that may extend from the wallboard, ceiling and/or other finished or un-finished surface, as shown in FIG. 2.

The one or more side walls 24 may be integrally formed with the base member 22. For example, the base member and the one or more side walls may be formed during an injection molding process as integral members. Alternatively, the side wall 24 may include one or more side wall members that are secured to the base member 22 by a suitable securing mechanism, such as an adhesive, epoxy, fasteners (e.g., screws, nails, rivets, etc.), etc.

Figure 4:
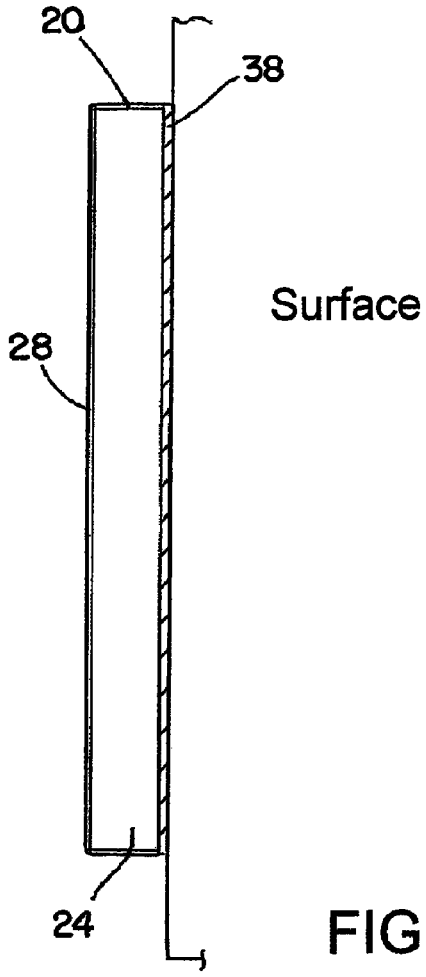
FIG. 4 is an exemplary side profile view of a register cover secured over a register in accordance with aspects of the present invention.
Figure 5:
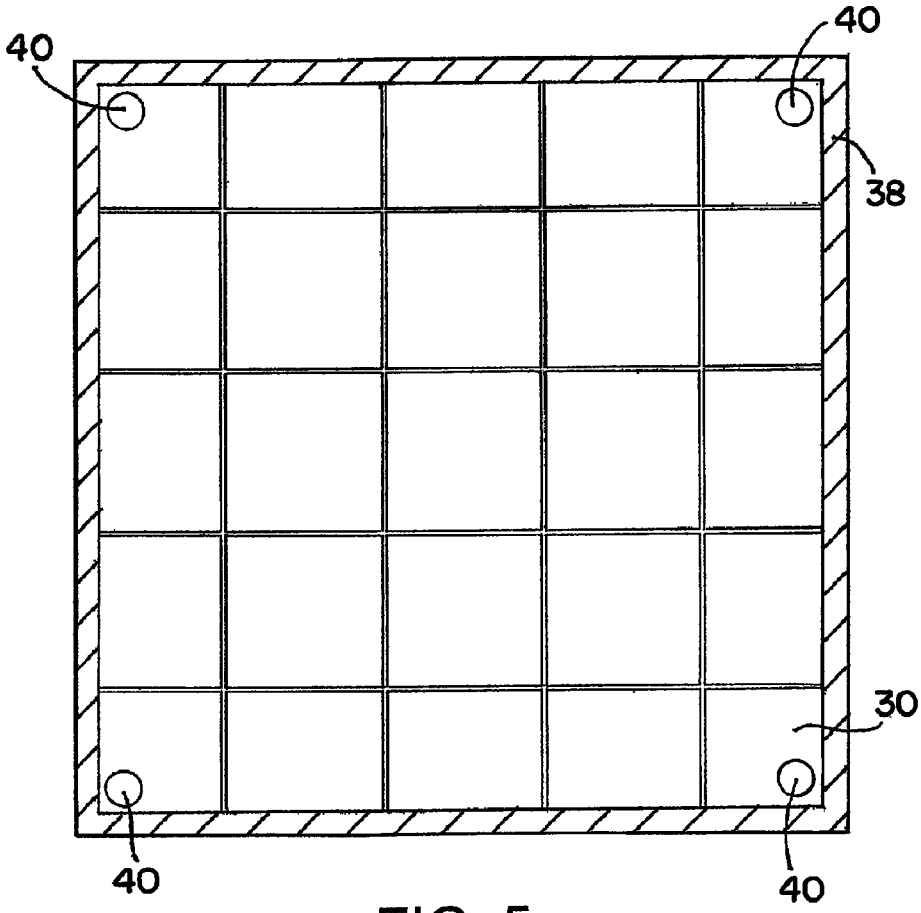
FIG. 5 is an exemplary rear surface plan view of the register cover in accordance with aspects of the present invention.

In one embodiment, the one or more side walls 24 may include a free end 34 that is tapered inward toward the cavity (C), such that the free end may fit tightly against the register 10 and the surface to prevent forced air from escaping the interface formed between the side walls 24 and the register 10. It may also be desirable to include an insulating member 38 (e.g. a gasket, insulation, a liner or other insulative element) that is attached along the free ends 34 of the side walls to prevent air from escaping the interface formed between the back surface 30, side walls 24 and the register 10, as shown in FIGS. 4 and 5. The sealing member 38 may be conformable to engage the side walls 24 and the surface surrounding the register.

Figure 6:
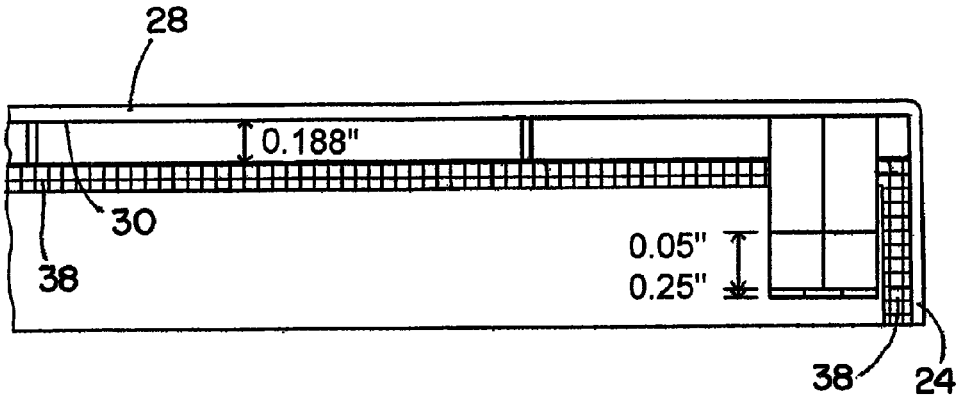
FIG. 6 is an exemplary side profile view of a register cover in accordance with aspects of the present invention.

In another embodiment, illustrated in FIG. 6, it may be desirable to have insulating member 38 secured along the back surface 30 and/or along an interior portion of the side walls 24 (e.g., within the cavity (C)). One of ordinary skill in the art will appreciate that the embodiments disclosed in FIGS. 4, 5 and 6 may be combined such that the cover 20 has insulating members 38 along the free ends 34 of the side walls, as well as along the back surface 30 and/or along an interior portion of the side walls.

Referring back to FIG. 3, a plurality of securing elements 26 are configured along the back surface 30 of the base member 22 to secure the base member to the associated register 20. This embodiment assumes that the associated register 20 is made of a material that has magnetic permeability suitable to attract the material to the magnet. A method is discussed below for retrofitting a non-metallic register to use with the register cover 20.

In the preferred embodiment, the securing elements 26 are magnets. Any type of magnet that is sufficient to secure the register cover 20 to the register 10 may be used in accordance with the present invention. Suitable magnets include, for example, common earth magnets, bar magnets, ring magnets, etc. As shown in FIG. 3, a plurality of magnets are used to secure the register cover to the register. It may be desirable to have more or fewer magnets depending on the size of the register 10, location of the register and/or any other design considerations.

As shown in FIG. 3, the securing elements 26 may be placed in predetermined locations around the back surface 30 of the register cover 20. The embodiment illustrated in FIG. 3 shows that there are four (4) fastening members 40 located in each corner of the register. One of ordinary skill in the art will readily appreciate that the fastening members 40 may be positioned in any desired location that will enable the securing elements 26 to sufficiently engage the register 10 so as to secure the register cover 20 to the register 10.

As shown in FIG. 3, the fastening members 40 may be integrally formed in the back surface 30 of the base member 22. For example, the fastening members 40 may be formed during injection molding of the cover 20.

In another embodiment, the fastening members may be separately attached to the back surface 30 of the base member. Any suitable attachment technique may be used to attach the fastening member 40 to the back surface 30 and/or side walls 24 of the register cover 20. For example, adhesives, screws, nails, rivets, suction cups, etc. may be used to secure the fastening members 40 to the register cover 20. Such an embodiment provides flexibility to attach the register cover 20 to a variety of register designs.

Figure 7:
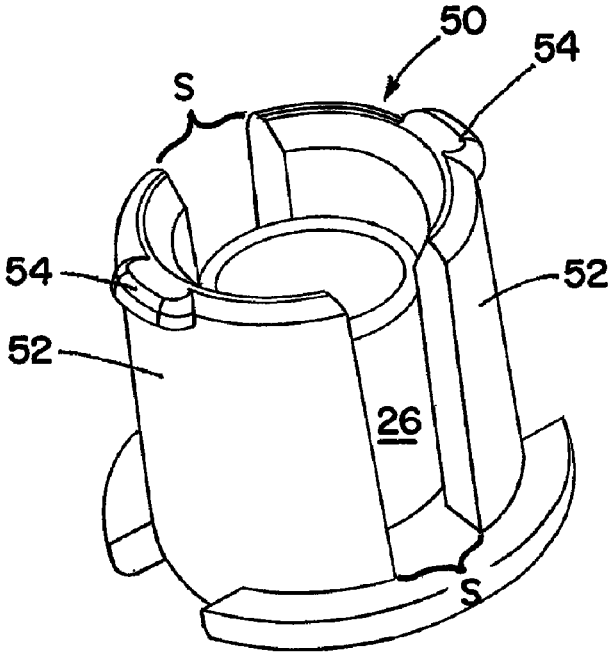
FIG. 7 is an exemplary perspective view of a cap enclosure in accordance with aspects of the present invention.

As shown in FIG. 7, the securing elements 26 may be housed in a cap 50, which may be secured to the fastening member 40. The cap 50 is suitably sized to hold the securing element 26. In one embodiment, each cap is configured to hold one securing element. As shown in FIG. 7, the cap 50 is configured to hold a single cylinder magnet. The cap 50 has opposing walls 52 to hold the securing element 26. The cap 50 is removably secured to the fastening member 40 located on the back surface 30 of the base member 22. The cap 50 includes a locking member 54 that interfaces with a groove 62 (FIG. 8) located on the fastening member 40 to secure the securing element 26 within the fastening member 40 and the cover 20, as shown in FIG. 7. One of ordinary skill in the art will readily appreciate that the cap member 50 may take different forms, depending on a variety of design considerations. Such design considerations include, for example, the type of securing element, the type of register that the register cover 20 is to be applied, the size and shape of the register that the register cover 20 is to be applied.

Figure 8:
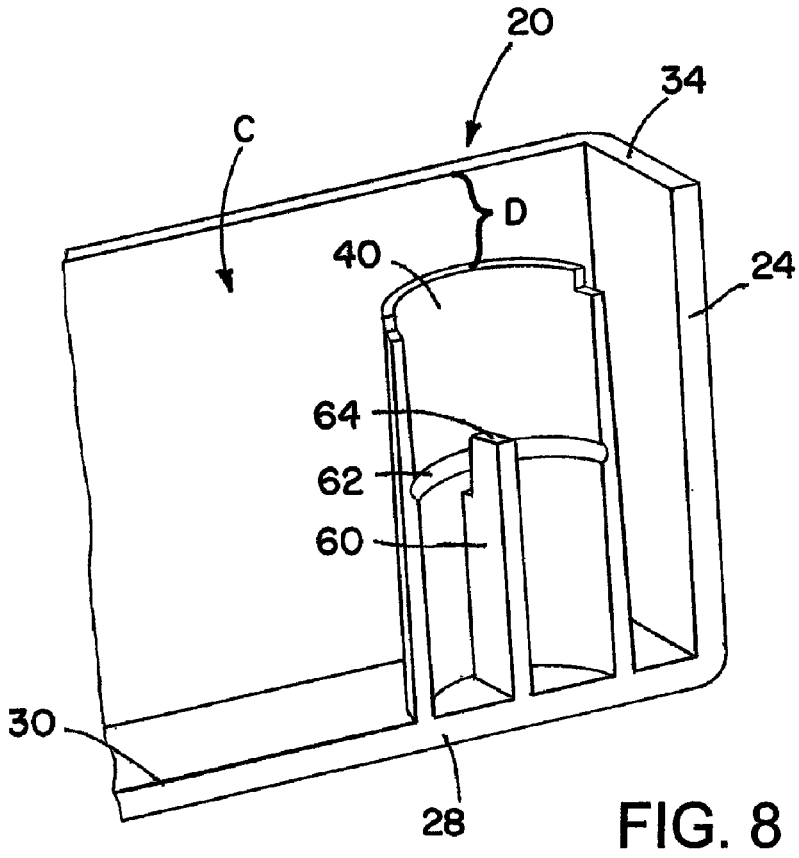
FIG. 8 is an exemplary cross-sectional perspective view of a fastening member in accordance with aspects of the present invention.

Referring to FIG. 8, a cross-sectional view of an exemplary fastening member 40 is illustrated. The illustrated fastening member 40 is integrally formed in the base member 22 and extends from the back surface 30 into the cavity (C). Referring to FIG. 7, the cap 50 includes opposing slots (S) formed between walls 52. The opposing slots are aligned with guides 60 in order to insert the cap 50 into the fastening member 40. When the cap 50 including the securing element 26 is inserted into the fastening member 40, the locking member 54 engages a groove 62 to lock the cap 50 and securing element 26 into the fastening element. The guide 60 further includes an end 64 that acts as a stop to position the securing element 26 (e.g., a magnet) in a desired position. Such a structure provides simple mechanism to lock the cap 50 into fastening member 40 in such a manner to position the securing element (e.g. the magnet) in a suitable position for securing the register cover to the register.

Referring to FIG. 8, the distance (D) between the fastening member 40 and the free end 34 of the side walls 24 should be sufficient to allow the entire register 10 to fit within the cover such that the free end 34 of the sidewalls rests substantially against the surface (e.g., wallboard, a wall, a ceiling, a finished surface, un-finished surface, etc.) in which the register is located.

As described above, the register cover 20 attaches in seconds to metal registers through the use of magnet securing elements, for example. When the register cover 20 is placed over a register, the side walls 24 come in contact with the surface that surrounds the register. The register cover 20 forms a tight seal over the register between the register cover and the surface surrounding the register, which eliminates the transfer of air from leaving and/or entering the register.

Figure 9:
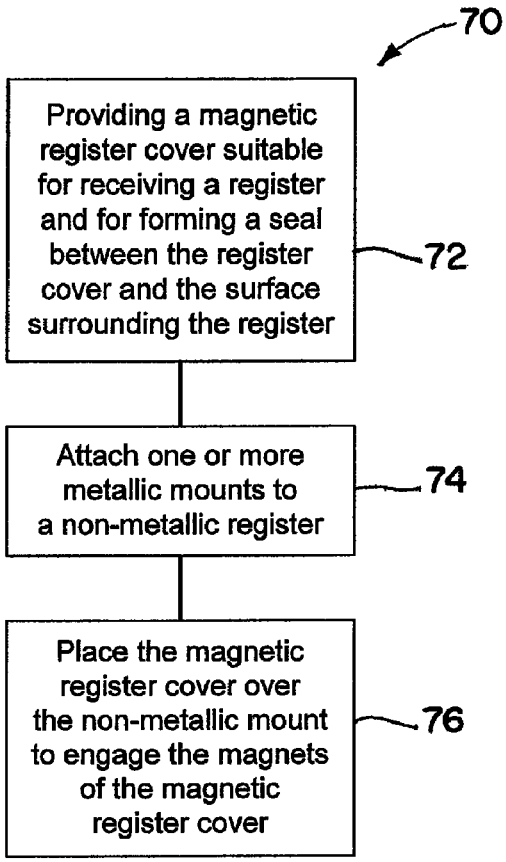
FIG. 9 is an exemplary flow diagram in accordance with aspects of the present invention.
Figure 10:
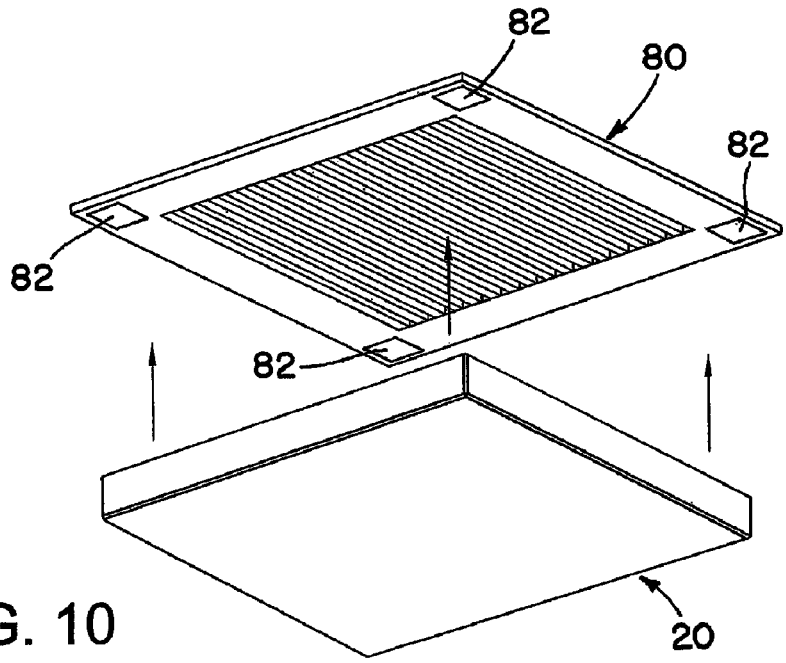
FIG. 10 is an exemplary perspective view of a register cover in accordance with aspects of the present invention and metal mounting elements placed on a conventional non-metallic register in accordance with aspects of the present invention.

Aspects of the present invention further relate to a method for attaching a magnetic register cover to a non-metallic register. Referring to FIG. 9, the method 70 includes, at block 72 by providing a register cover 20, wherein the register cover includes a base member 22 impervious to air. The base member includes a front surface 28 and a back surface 30; a side wall 24 extending from the base member along a perimeter of the base member, wherein the side wall and the back surface form a cavity (C) for receiving an associated non-metallic register 80 (FIG. 10) and the cavity (C) completely covers the associated non-metallic register; and a plurality of a magnets 26 configured along the back surface to secure the base member to the associated non-metallic register.

At block 74, one or more metallic mounts 82 are attached to the associated non-metallic register 80. The mounts are positioned in such a manner to correspond generally the positions of the magnetic securing elements 26, such that the one or more metallic mounts 82 are configured to magnetically engage the magnets 26 of the register cover. The metallic mounts 82 may be secured to the non-metallic register 80 in any desired manner. For example, metallic mounts 82 may be secured to the associated non-metallic register through an adhesive, hook and loop fasteners (e.g,.Velcro®), screws, nails, rivets, etc.

At block 76, the register cover 20 is placed over the associated non-metallic register 80 to engage the magnets 26 with the metallic mounts 82. The magnets 26 disposed in the register cover 20 secure the register cover 20 to the one or more metallic mounts 82 and creates an interface between the sidewall 24 and back surface 30 of the register cover 20 and the associated non-metallic register 80 such that forced air is substantially prevented from escaping through the interface.

While the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself. Thus, for example, any sequence(s) and/or temporal order of steps of various processes or methods that are described herein are illustrative and not restrictive.

Although the invention has been shown and described with respect to certain embodiments, it is understood that equivalents and modifications will occur to others skilled in the art upon the reading and understanding of the specification. The present invention includes all such equivalents and modifications, and is limited only by the scope of the following claims.

What is claimed is:

1. A register cover comprising:

a base member impervious to air, wherein the base member includes a front surface and a back surface;

a side wall extending from the base member along a perimeter of the base member, wherein the side wall and the back surface form a cavity for receiving an associated register, wherein the cavity completely covers the associated register including register sidewalls; and a plurality of a magnets configured along the back surface to secure the base member to the associated register, wherein the magnets are housed in at least one cap that is removably secured to a fastening member located on the back surface of the base member.

2. The register cover of claim 1, wherein the base member is a planar surface.

3. The register cover of claim 1, wherein front surface includes a decorative design.

4. The register cover of claim 1, wherein the side wall extending from the base member is integrally formed with the base member.

5. The register cover of claim 1, wherein the side wall extending from the base member is secured to the base member.

6. The register cover of claim 1, wherein the cavity formed between the sidewall and back surface is configured to prevent forced air from escaping through an interface formed between the back surface, the side wall and the associated register.

7. The register cover of claim 1, wherein the base member includes one or more stiffening ribs to increase the stiffness of the base member.

8. The register cover of claim 1, wherein the cap includes a locking member that interfaces with the fastening member to secure the the plurality of magnets to the register cover.

9. The register cover of claim 1, wherein the fastening member is integrally formed in the back surface of the base member.

10. The register cover of claim 1, wherein the fastening member is couple to the back surface of the base member.

11. The register cover of claim 1, wherein the at least one cap is a plurality of caps and each of the plurality of caps is configured to house at least one of the plurality of magnets.

12. The register cover of claim 1 wherein, the register cover is manufactured from at least one material selected from the group consisting of an acrylonitrile-butadiene-styrene (ABS) material or a polyvinyl chloride (PVC) material.

13. A method for attaching a magnetic register cover to a non-metallic register, the method comprising:

providing a register cover, wherein the register cover includes a base member impervious to air, wherein the base member includes a front surface and a back surface; a side wall extending from the base member along a perimeter of the base member, wherein the side wall and the back surface form a cavity for receiving an associated non-metallic register and the cavity completely covers the associated non-metallic register; and a plurality of a magnets configured along the back surface to secure the base member to the associated non-metallic register, wherein the magnets are housed in at least one cap that is removably secured to a fastening member located on the back surface of the base member;

attaching one or more metallic mounts to the associated non-metallic register, wherein the one or more metallic mounts are configured to magnetically engage the magnets of the register cover;

placing the register cover over the associated non-metallic register, wherein the magnets of the register cover secure the register cover to the one or more metallic mounts and the register cover to create an interface between the sidewall and back surface of the register cover and the associated non-metallic register such that forced air is prevented from escaping through the interface.

14. The method of claim 13, wherein the one or more metallic mounts are secured to the associated non-metallic register through an adhesive.

15. The method of claim 13, wherein the one or more metallic mounts are secured to the associated non-metallic register through a hook and loop fastener.

* * * * *